US007121177B2

(12) United States Patent
Hatano

(10) Patent No.: US 7,121,177 B2
(45) Date of Patent: Oct. 17, 2006

(54) METHOD AND APPARATUS FOR PUNCHING OUT A PLURALITY OF PARTS FROM TAPE-LIKE MEMBER

(75) Inventor: Yasushi Hatano, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 11/326,374

(22) Filed: Jan. 6, 2006

(65) Prior Publication Data

US 2006/0174738 A1 Aug. 10, 2006

(30) Foreign Application Priority Data

Feb. 4, 2005 (JP) ..... 2005-029373

(51) Int. Cl.
*B26D 7/01* (2006.01)
*B26D 7/00* (2006.01)
*B26D 5/00* (2006.01)

(52) U.S. Cl. ..... 83/13; 83/371; 83/72

(58) Field of Classification Search ..... 83/13, 83/371

See application file for complete search history.

(56) References Cited

U.S. PATENT DOCUMENTS 5,212,647 A * 5/1993 Raney et al. ..... 83/76.7
5,244,250 A * 9/1993 Nordmeyer ..... 297/59
5,777,879 A * 7/1998 Sommerfeldt ..... 83/371
6,546,833 B1 * 4/2003 Gifford et al. ..... 83/371
6,666,122 B1 * 12/2003 Raney et al. ..... 83/451
2002/0124699 A1 * 9/2002 Ishii et al. ..... 83/76.7

FOREIGN PATENT DOCUMENTS

JP 11-77589 A 3/1999
JP 2004-56008 A 2/2004

* cited by examiner

*Primary Examiner*—Derris H. Banks
*Assistant Examiner*—Sean M. Michalski
(74) *Attorney, Agent, or Firm*—Sughrue Mion, PLLC

(57) ABSTRACT

Method and apparatus for punching out a plurality of parts from a tape-like member including the parts to be punched out and positioning holes. The method and apparatus execute the steps of: a capturing step for capturing one after another an image of at least one positioning hole and a corresponding part; a position detecting step for detecting a positional relation between the positioning hole and the part based on the captured image; an adjusting step for adjusting, based on the positional relation, a position of the die set relative to the positioning pin when the part is set on the die set, so that a cutting-plane line is arranged along a contour of the part; and a punching out step for punching out the part by the die set after placing the part on the die set with the positioning pin being inserted into the positioning hole.

20 Claims, 6 Drawing Sheets

(b)

METHOD AND APPARATUS FOR PUNCHING OUT A PLURALITY OF PARTS FROM TAPE-LIKE MEMBER

CROSS REFERENCE TO RELATED APPLICATIONS

This application claims the foreign priority benefit under Title 35, United States Code, §119(a)–(d) of Japanese Patent Application No. 2005-029373, filed on Feb. 4, 2005 in the Japan Patent Office, the disclosure of which is herein incorporated by reference in its entirety.

BACKGROUND OF THE INVENTION

An apparatus and a method consistent with the present invention relate to punching out a plurality of parts from a tape-like member to produce products (cutouts).

Various methods have been known to punch out parts to be punched out (hereinafter also referred to as parts) from a tape-like member on which are arranged a plurality of parts to be used as electronic parts along the longitudinal direction. Parts are punched out by a press machine.

For example, Japanese Laid-open Patent Application No. 11-77589 (see paragraphs [0027] to [0028] and FIG. 1) discloses a method for punching out parts from a tape-like member, which includes the steps of positioning a part on a die set of a press machine, capturing with a sensor (CCD camera) provided at the die set a mark printed on the tape-like member in the vicinity of the part, adjusting the position of the die set based on the positional relation between the mark and the sensor so that the cutting-plane line is arranged along the contour of the part, and punching out the part to obtain a cutout. According to this method, the die set is moved in the direction in which the tape-like member is transferred, the direction along the width of the tape-like member, and the turning direction around the vertical axis, on the basis of the marks printed on the tape-like member, so that the cutting-plane line is arranged along the contour of the part. Namely, positioning of the die set is carried out with respect to the mark.

Japanese Laid-open Patent Application No. 2004-56008 (see paragraph [0061] and FIG. 4) discloses a method for punching out parts from a tape-like member, which includes the steps of capturing with a camera provided in the a press machine a mark printed on a part in a step prior to setting the part on the die set, and adjusting the position of the tape-like member in the direction for transferring the tape-like member and the direction along the width of the tape-like member based on the positional relation between the mark and the camera, so that the cutting-plane line is arranged along the contour of the part that is set on the die set. According to this method, the positional relation between the parts and the die set can be adjusted on the basis of the mark of the tape-like member. Namely, positioning of the mark on the tape-like member is carried out with respect to the die set.

In these punching-out methods, the position of the die set or the tape-like member is adjusted with respect to the parts to be punched out on the basis of the marks printed on the tape-like member in a certain position relative to the parts. However, if the position of a mark is deviated from/in the corresponding part on the tape-like member, the positional relation between the reference position and the part becomes different from the previously set positional relation. Therefore, even if the position of the tape-like member or the die set is adjusted based on the positional relation of the sensor or the camera relative to the mark, the cutting-plane line will not be arranged along the contour of the part.

Illustrative, non-limiting embodiments of the present invention overcome the above disadvantage and other disadvantages not described above.

SUMMARY OF THE INVENTION

It is an aspect of the present invention to provide a method for punching out a plurality of parts to be punched out from a tape-like member, in which the cutting-plane line is accurately positioned along the contour of the parts when the parts embedded in the tape-like member are set on the die set.

According to the present invention, there is provided a method for punching out a plurality of parts from a tape-like member to produce cutouts by using a press machine equipped with a die set and a positioning pin. The tape-like member includes the plurality of parts to be punched out and positioning holes for positioning the parts. The method comprises the steps of: a capturing step for capturing one after another an image of at least one positioning hole and a corresponding part; a position detecting step for detecting a positional relation between the positioning hole and the part based on the image obtained in the capturing step; an adjusting step for adjusting, based on the positional relation between the positioning hole and the part, a position of the die set relative to the positioning pin when the part is set on the die set, so that a cutting-plane line is arranged along a contour of the part; and a punching out step for punching out the part by the die set to produce a cutout after placing the part on the die set with the positioning pin being inserted into the positioning hole.

In this method, the relative position of the die set relative to the positioning pin is adjusted based on the positional relation of the part relative to the positioning hole of the tape-like member. When the part is set on the die set, the positioning pin of the press machine is inserted into the corresponding positioning hole, so that the positioning hole and the positioning pin are always arranged in the same position. In other words, when the part is set on the die set, the positional relation of the part relative to the positioning pin, as a reference upon adjusting the position of the die set, is consistent with the positional relation of the part relative to the positioning hole. This can enable the cutting-plane line to be accurately arranged along the contour of the part that is placed on the die set. According to the present invention, it is possible to improve the working accuracy for cutouts (products) as well as to improve the yield (percentage).

In the aforementioned method for punching out a plurality of parts from a tape-like member, the position detecting step may comprise detecting a positional relation between the positioning hole and a corner portion of the part. The detection of the positional relation between the positioning hole and the corner portion of the part may be carried out by detecting a positional relation between a barycenter of the positioning hole and a barycenter of the corner portion.

In this method, because the positional relation between the positioning hole and the part is detected based on the positional relation between the positioning hole and the corner portion of the part, the position and the direction of the part is readily detected, which leads to an accurate adjustment of the die set.

In the aforementioned method for punching out a plurality of parts from a tape-like member, a positional relation between the positioning hole and a reference mark printed on the part may be detected in the position detecting step.

Further, in the aforementioned method, the adjusting step may further include a step for moving the die set along a longitudinal direction and a width direction of the tape-like member. Also, the adjusting step may further include a step for turning the die set around a vertical axis of the die set.

Moreover, in the aforementioned method, a relative position of the part relative to the positioning hole may be detected in the position detecting step, and the adjusting step may further include a displacement distance calculating step which includes a step for comparing the current relative position of the part relative to the positioning hole with the previous relative position that has just been detected, and a step for calculating displacement distances on the basis of the comparison result.

It is another aspect of the present invention to provide an apparatus for punching out a plurality of parts from a tape-like member, in which the cutting-plane line is accurately positioned along the contour of the parts when the parts embedded in the tape-like member are set on the die set.

According to the present invention, there is provided an apparatus for punching out parts to be punched out from a tape-like member to produce cutouts. The tape-like member includes along its longitudinal direction the plurality of parts to be punched out and positioning holes for positioning the parts. The apparatus comprises: a transferring system which transfers the tape-like member along the longitudinal direction of the tape-like member; a press machine including a die set which punches out one after another the parts when the tape-like member is transferred to and stopped on the die set, and a positioning pin provided near the die set and inserted into a corresponding positioning hole when each of the parts is punched out, each of the positioning hole being provided in a predetermined position close to an outside of each part; an image capturing device which is provided upstream of the press machine as viewed from the transferring direction of the tape-like member, and captures an image of each part and the corresponding positioning hole; and a positioning controller which detects a positional relation between the positioning hole and the part based on the image obtained by the image capturing device, and based on the positional relation between the positioning hole and the part, adjusts a position of the die set relative to the positioning pin when the part is set on the die set, so that a cutting-plane line is arranged along a contour of the part. And in a state where the part is set on the die set and the positioning pin is inserted into the positioning hole, the die set, the position of which has been adjusted by the positioning controller, punches out the part to produce a cutout.

In the aforementioned apparatus for punching out a plurality of parts from a tape-like member, the transferring system may include: a supply reel for feeding out the tape-like member toward the press machine; a take-up reel for taking up the tape-like member from which the parts have been punched out; and a pair of guide rollers each provided upstream and downstream of the press machine and guiding the tape-like member. Further, each guide roller has guide pins engageable with perforation holes provided along both outer edges of the tape-like member along the parts, so that rotation of the guide rollers allows the tape-like member to be fed out downstream, and one of the perforation holes, which positions in a predetermined position close to the part, may be used as the positioning hole.

In the aforementioned apparatus for punching out a plurality of parts from a tape-like member, the positioning controller may include: a position detecting unit which detects a relative position of the part relative to the positioning hole based on the image captured by the image capturing device; a displacement distance calculating unit which calculates displacement distances of the die set such that the position of the die set relative to the positioning pin is consistent with the relative position of the part relative to the positioning hole that is detected by the position detecting unit; and a movement instructing unit which produces an instructing signal based on the displacement distances calculated by the displacement distance calculating unit and transmits the same to the press machine.

Further, in the aforementioned apparatus for punching out a plurality of parts from a tape-like member, the press machine may include a driving unit which receives the instructing signal outputted from the movement instructing unit and then moves the die set along a longitudinal direction and a width direction of the tape-like member based on this instructing signal.

In the aforementioned apparatus, the press machine may include a driving unit which receives the instructing signal outputted from the movement instructing unit and then turns the die set around a vertical axis of the die set based on this instructing signal.

Further, in the aforementioned apparatus, the position detecting unit may detect a positional relation between the positioning hole and a corner portion of the part.

In the aforementioned apparatus, the detection of the positional relation between the positioning hole and the corner portion of the part may be carried out by detecting a positional relation between a barycenter of the positioning hole and a barycenter of the corner portion. Further, the position detecting unit may detect a positional relation between the positioning hole and a reference mark printed on the part.

In the aforementioned apparatus, the part may be a cartridge memory used for a tape-like storage media cartridge. Further, the image capturing device may comprise a CCD camera.

According to the present invention, there is also provided an apparatus for punching out a plurality of parts from a tape-like member to produce cutouts by using a press machine equipped with a die set and a positioning pin. The tape-like member includes the plurality of parts to be punched out and positioning holes for positioning the parts. The apparatus comprises: a capturing means for capturing one after another an image of at least one positioning hole and a corresponding part; a position detecting means for detecting a positional relation between the positioning hole and the part based on the image obtained by the capturing means; an adjusting means for adjusting, based on the positional relation between the positioning hole and the part, a position of the die set relative to the positioning pin when the part is set on the die set, so that a cutting-plane line is arranged along a contour of the part; and a punching out means for punching out the part by the die set to produce a cutout after placing the part on the die set with the positioning pin being inserted into the positioning hole.

In the aforementioned apparatus, the position detecting means may comprise means for detecting a positional relation between the positioning hole and a corner portion of the part. Further, the position detecting means may comprise means for detecting a positional relation between the positioning hole and a reference mark printed on the part.

Other features and advantages of the present invention will be apparent from the following description.

BRIEF DESCRIPTION OF THE DRAWINGS

The aspects of the present invention will become more apparent by describing in detail illustrative, non-limiting embodiments thereof with reference to the accompanying drawings, in which:

FIGS. 1A and 1B show a cartridge memory produced by a method for punching out a plurality of parts to be punched out according to one embodiment of the present invention, in which FIG. 1A is a top plan view, and FIG. 1B is a side view;

FIGS. 4A and 4B show a press machine used for the method for punching out a plurality of parts, in which FIG. 4A is a front elevational view, and FIG. 4B is a side elevational view;

DETAILED DESCRIPTION OF EXEMPLARY EMBODIMENTS OF THE INVENTION

In this exemplary embodiment of the invention, explanation will be given to an instance where cartridge memories (RFID tag) for magnetic tape cartridge are produced.

Configuration of Cartridge Memory

A cartridge memory is installed in a cartridge case of the magnetic tape cartridge. The cartridge memory stores management data inherent in the cartridge, such as data stored in the magnetic tape cartridge, and kind of the magnetic tape cartridge.

Figure 1A:
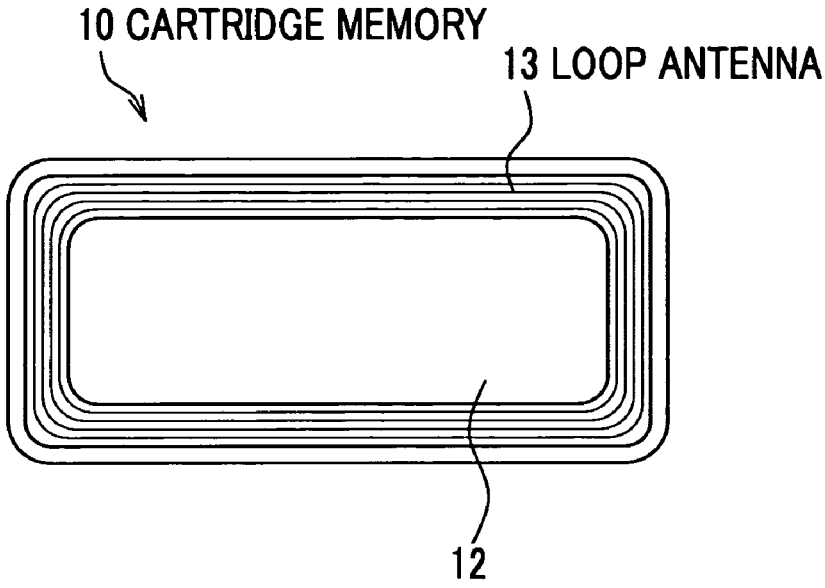
Figure 1B:
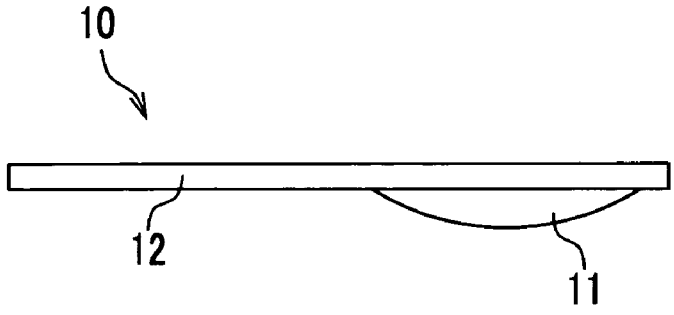

As shown in FIGS. 1A and 1B, the cartridge memory 10 is a semiconductor memory device in the shape of a rectangular thin plate. At the reverse surface, the cartridge memory 10 is provided with an IC chip (not shown) embedded in a glob top 11 which is a sealant consisting of resins, and the IC chip is wired with a loop antenna 13 printed on the upper surface of the printed circuit board 12.

Figure 2:
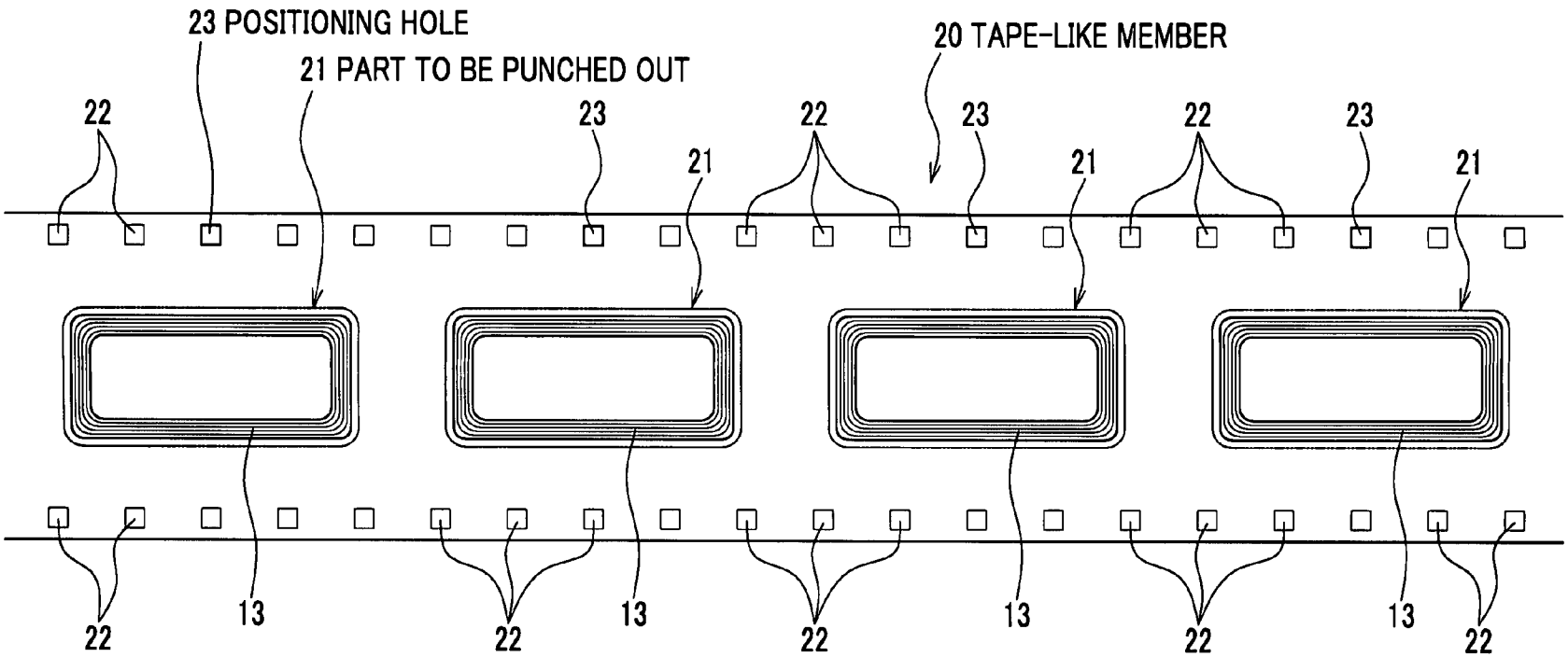
FIG. 2 is a top plan view of a tape-like member used for the method for punching out a plurality of parts.

As shown in FIG. 2, a plurality of cartridge memories 10 are arranged as parts to be punched out 21 along the longitudinal direction of a tape-like member 20. The cartridge memory 10 is produced by punching out parts 21 from the tape-like member 20 to produce cutouts (cartridge memories 10) using a press machine 40 (see FIG. 3).

It is preferable that the size of the cartridge memory 10 is small, because the cartridge memory 10 is accommodated in the cartridge case. For this reason, when the press machine 40 punches out the parts 21 from the tape-like member 20, the parts 21 are punched out along the periphery of the loop antenna 13 such that the outer profile of the printed circuit board 12 approximates with that of the loop antenna 13, so that cartridge memories 10 are produced as small as possible.

Figure 3:
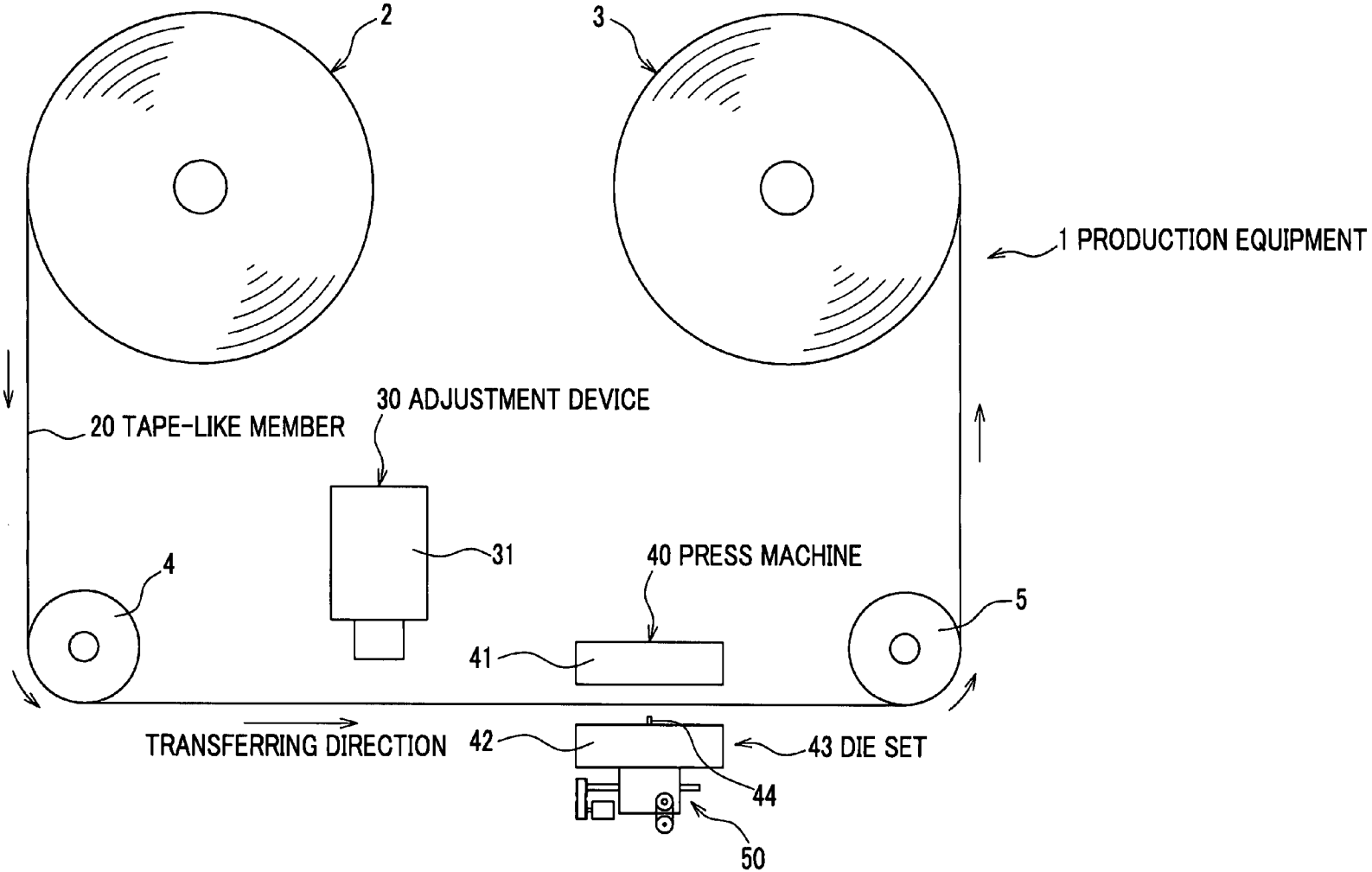
FIG. 3 is a schematic view of a production equipment used for the method for punching out a plurality of parts.

The loop antennas 13 are printed on the upper surface of the parts 21 (top side of the tape-like member 20 as seen in FIG. 3), and the glob top 11 (FIG. 1B) in which an IC chip is embedded is provided at the reverse surface of the parts 21.

The tape-like member 20 further includes a plurality of perforation holes 22 provided along both outer edges of the tape-like member 20. The perforation holes 22 are arranged equidistantly along the longitudinal direction of the tape-like member 20, so that when the tape-like member 20 runs along its longitudinal direction, guide pins of a guide roller are engaged with and inserted into the perforation holes 22.

Of these perforation holes 22, one perforation hole 22 that is positioned adjacently to the upper center along the longitudinal direction of each part 21 as illustrated in FIG. 2 is utilized as a positioning hole 23, into which a positioning pin 44 (FIG. 4B) of the press machine 40 (FIG. 3) is inserted when the tape-like member 20 is set on the die set 43 of the press machine 40. The positioning hole 23 may be arbitrarily selected from among the plurality of perforation holes 22.

Configuration of Production Equipment

As best seen in FIGS. 2 and 3, production equipment 1 includes a supply reel 2 for feeding out the tape-like member 20 with a plurality of parts 21, the press machine 40 for punching out the parts 21 from the tape-like member 20, and a take-up reel 3 for taking up the tape-like member 20 from which the parts 21 have been punched out. An adjustment device 30 for adjusting the position of the die set 43 of the press machine 40 is further provided upstream of the press machine 40 as viewed from the transferring direction of the tape-like member 20.

Reference numerals 4 and 5 denote guide rollers for guiding and running the tape-like member 20. Guide pins (not shown) of the guide rollers 4, 5 are engaged with and inserted into the perforation holes 22 of the tape-like member 20, so that rotation of the guide rollers 4, 5 causes the tape-like member 20 to be fed out downstream.

Configuration of Press Machine

The press machine 40 is equipped with a die set 43 having a press die 41 and a die table 42, which are arranged vertically to each other as illustrated in FIG. 3. The tape-like member 20 is transferred between the press die 41 and the die table 42.

As shown in FIG. 4, when the press machine 40 punches out parts 21 from the tape-like member 20, each part 21 (FIG. 2) embedded in the tape-like member 20 is placed on the die table 42 and then the press die 41 lowers toward the part 21 until it abuts on the die table 42.

The press machine 40 is also equipped with the positioning pin 44. The positioning pin 44 is inserted into the positioning hole 23 of the tape-like member 20 (FIG. 2) when the part 21 embedded in the tape-like member 20 is set on the die table 42.

When the part 21 is set on the die table 42, the positioning hole 23 and the positioning pin 44 are always arranged in the same position on the die table 42, and the position of the part 21 placed on the die table 42 is fixed by the positioning pin 44.

The press machine 40 is further equipped with a driving unit 50 which moves the die set 43 along the longitudinal direction and the width direction of the tape-like member 20.

Figure 4B:
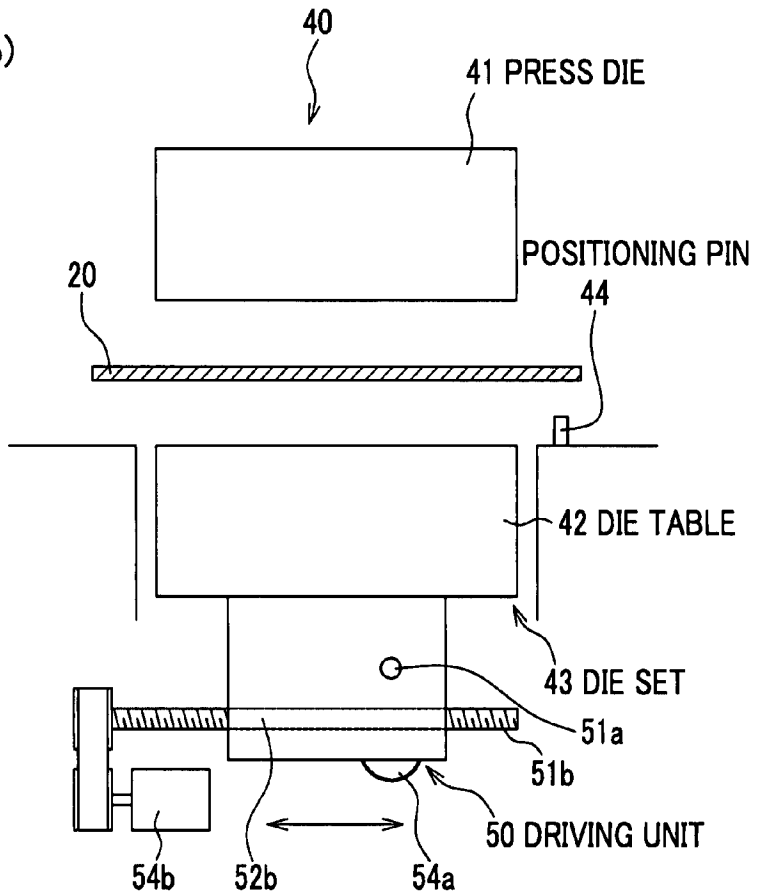
Figure 4A:
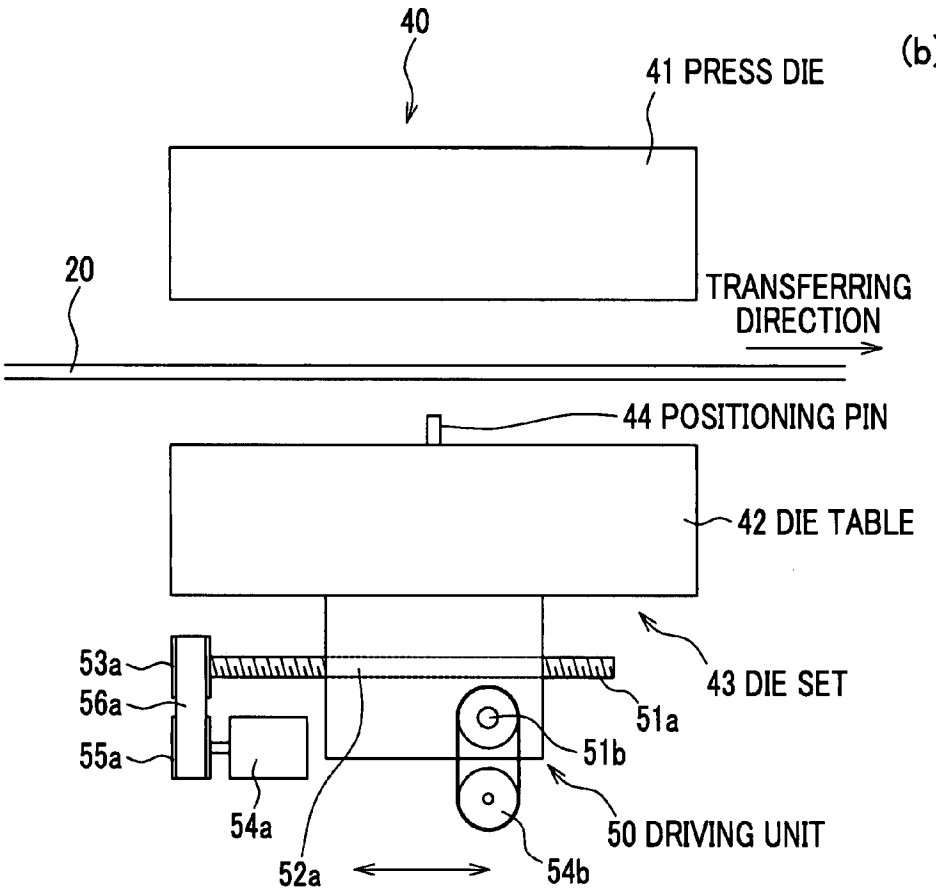

As shown in FIG. 4A, the driving unit 50 includes a ball screw 51*a* extending along the longitudinal direction of the tape-like member 20. The ball screw 51*a* threadedly engages with an internally threaded hole 52*a* that is provided at and extends through the lower portion of the die table 42 along the longitudinal direction of the tape-like member 20. Provided at one end of the ball screw 51*a* is a pulley 53*a*, to which an endless belt 56*a* is wound over. The endless belt 56*a* is looped over the pulley 53*a* and a pulley 55*a* which is fixed to the drive shaft of a motor 54*a*, such as a pulse motor and a servo motor. When the drive shaft of the drive motor 54*a* is rotated in a desired direction, the driving force generated by the drive motor 54*a* is transmitted to the ball screw 51*a* through the belt 56, thereby rotating the ball screw 51*a* at a fixed position along the axis of the ball screw 51*a*. The rotation of the ball screw 51*a* then makes the die table 42 that is guided by the threads of the ball screw 51*a* move along the longitudinal direction of the tape-like member 20. The press die 41 is coupled with and moved together with the die table 42, so that the driving unit 50 can move the die set 43 along the longitudinal direction of the tape-like member 20.

Similar to the above configuration for moving the die set 43 along the longitudinal direction of the tape-like member 20, the driving unit 50 also includes a configuration for moving the die set 43 along the width direction of the tape-like member 20. To be more specific, as illustrated in FIG. 4B, the driving unit 50 includes a ball screw 51*b* extending along the width direction of the tape-like member 20. The ball screw 51*b* threadedly engages with an internally threaded hole 52*b* that is provided at and extends through the lower portion of the die table 42 along the width direction of the tape-like member 20. When the drive shaft of the drive motor 54*b* is rotated in a desired direction, the die set 43 that is guided by the threads of the ball screw 51*b* moves along the width direction of the tape-like member 20.

Configuration of Adjustment Device

Figure 5:
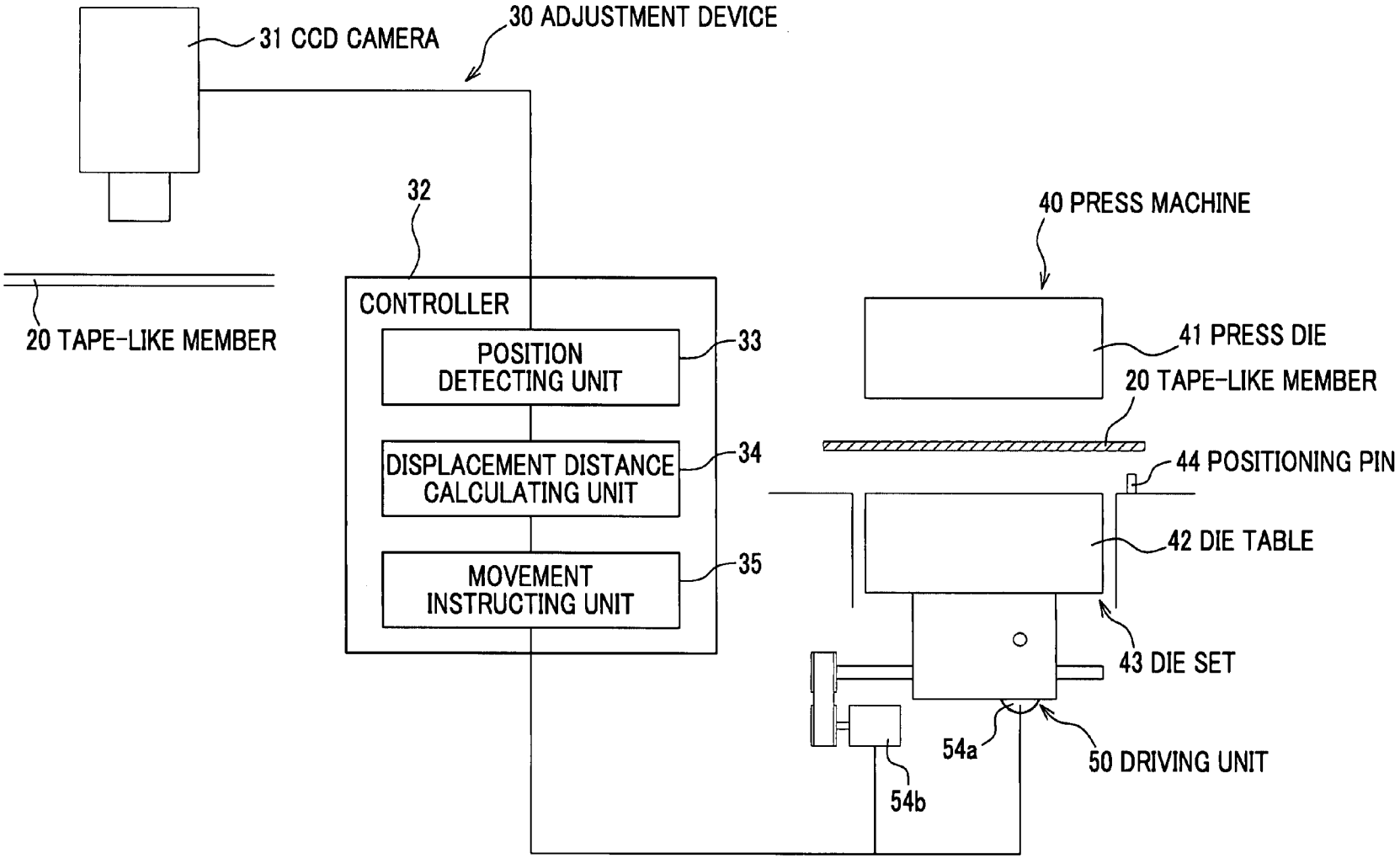
FIG. 5 is a schematic diagram illustrating a control unit of the press machine used for the method for punching out a plurality of parts.

As shown in FIG. 5, the adjustment device 30 includes a CCD (Charged Coupled Device) camera 31 for capturing an image of the top surface of the tape-like member 20, and a controller 32 which sends instructions to the driving unit 50 of the die set 43 based on the image captured by the CCD camera 31 such that when the part 21 (FIG. 2) embedded in the tape-like member 20 is set on the die set 43, a cutting-plane line is arranged along the contour of the part 21.

The CCD camera 31 is located facing to the top surface of the tape-like member 20. The CCD camera 31 outputs to a position detecting unit 33 of the controller 32 a captured image including the positioning hole 23 of the tape-like member 20 and the part 21.

As best seen in FIG. 5, the controller 32 mainly consists of the position detecting unit 33 which detects the positional relation between the positioning hole 23 and the part 21 on the basis of the captured image from the CCD camera 31, a displacement distance calculating unit 34 which calculates displacement distances of the die set 43 required for conforming the cutting-plane line with the contour of the part 21 that is set on the die set 43, and a movement instructing unit 35 which outputs to the die set 43 an instructing signal for movement based on the displacement distances calculated by the displacement distance calculating unit 34.

The controller 32 is configured by a known computer, and the position detecting unit 33, the displacement distance calculating unit 34, and the movement instructing unit 35 are realized when the CPU (Central Processing Unit) performs processing according to a predetermined program.

Figure 6:
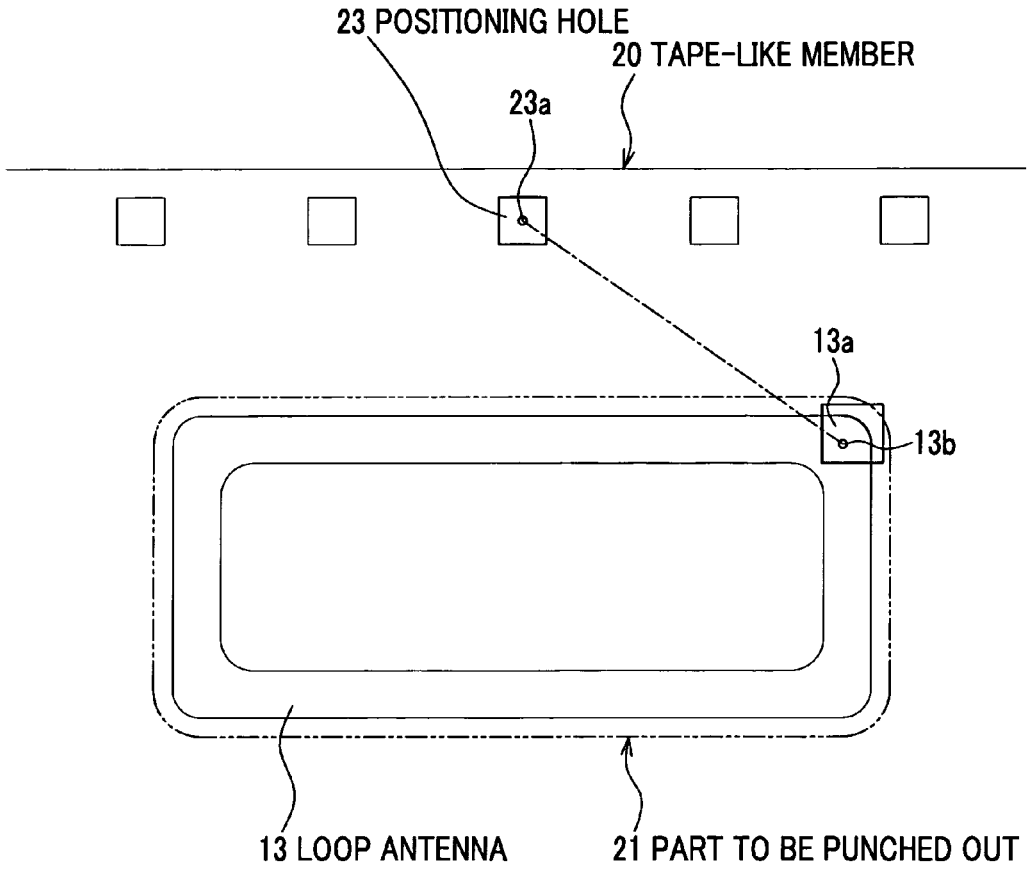
FIG. 6 is a top plan view illustrating how to detect a position of the part to be punched out in the method for punching out a plurality of parts.

As shown in FIGS. 5 and 6, the position detecting unit 33 detects the positional relation between the positioning hole 23 and the part 21 based on the captured image from the CCD camera 31. To be more specific, the position detecting unit 33 detects a relative position between the reference position 13*b* of a corner portion 13*a* of the loop antenna 13 and the barycenter 23*a* of the positioning hole 23. The cartridge memory 10 is produced by punching out the part 21 from the tape-like member 20 after positioning the periphery of the printed circuit board 12 in the proximity of the periphery of the loop antenna 13. It is important not to damage the loop antenna 13 upon punching out the part 21. According to this embodiment, the position of the part 21 is detected based on the periphery of the loop antenna 13.

In this embodiment, the corner portion 13*a* of the loop antenna 13 is defined by one positioned at the upper right corner, as viewed in FIG. 6, of four corner portions. The reference position 13*b* of the corner portion 13*a* is defined by the barycenter of an arc which forms the corner portion 13*a*.

As seen in FIG. 5, the displacement distance calculating unit 34 calculates displacement distances of the die set 43 that is required to conform the cutting-plane line with the contour of the part 21 set on the die set 43.

When the part 21 is set on the die set 43, the positioning hole 23 and the positioning pin 44 of the press machine are always arranged in the same position.

The displacement distance calculating unit 34 calculates the displacement distances of the die set 43 relative to the positioning pin 44 based on the relative position of the part 21 and the positioning hole 23 detected by the position detecting unit 33.

The displacement distance calculating unit 34 compares the current position of the part 21 relative to the positioning hole 23 with the previous position that has just been detected and by which the part 21 has been punched out, and calculates the displacement distances of the die set 43 on the basis of the comparison result.

As seen in FIG. 5, the movement instructing unit 35 outputs the instructing signal to the drive motor 54*a* and the drive motor 54*b* of the driving unit 50 for moving the die set 43 based on the displacement distances calculated by the displacement distance calculating unit 34, so that the die set 43 is moved along the longitudinal direction and the width direction of the tape-like member 20.

The displacement distance calculating unit 34 according to this embodiment calculates the relative displacement distances of the die set 43 for a part 21 that is positioned upstream of and several parts away from the part 21 set on the die set 43. For this reason, the movement instructing unit 35 stores one after another the relative displacement distances calculated by the displacement distance calculating unit 34, and extracts the corresponding relative displacement distances when the part 21 is set on the die set 43, so as to output the instructing signal on the basis of the relative displacement distances.

Punching Out Cartridge Memories

Explanation will be given to the punching-out method for producing cartridge memories 10 (FIG. 1) using the production equipment shown in FIG. 3, wherein parts 21 are punched out from the tape-like member 20 as shown in FIG. 2 to produce cartridge memories 10.

Capturing Step

As best seen in FIGS. 2 and 3, the CCD camera 31 captures an image of the top surface of the tape-like member 20 that has been fed out from the supply reel 2, and outputs the captured image including the positioning hole 23 and the part 21 to the position detecting unit 33 of the controller 32.

Position Detecting Step

As seen in FIGS. 5 and 6, the position detecting unit 33 of the controller 32 detects the positional relation between the barycenter 23*a* of the positioning hole 23 and the reference position 13*b* of the corner portion 13*a* of the loop antenna 13, from the captured image outputted from the adjustment device 30. It becomes possible to accurately detect the position of the part 21 by detecting the positional relation between the positioning hole 23 and the corner portion 13*a* of the loop antenna 13.

Adjusting Step

As seen in FIG. 5, the displacement distance calculating unit 34 calculates, based on the positional relation between the positioning hole 23 and the part 21 that is detected by the position detecting unit 33, the displacement distances of the die set 43 relative to the positioning pin 44 that is required to conform the cutting-plane line with the contour of the part 21 set on the die set 43.

Further, based on the displacement distances calculated by the displacement distance calculating unit 34, the movement instructing unit 35 outputs the instructing signal to the driving unit 50 for the die set 43, so that when the part 21 is set on the die set 43, the die set 43 moves to the position at which the cutting-plane line is arranged along the contour of the part 21.

Punching Out Step

As seen in FIGS. 4A and 4B, the tape-like member 20 is lowered by a known mechanism (not shown) and the part 21 is placed on the die table 42. In this position of the part 21, the positioning pin 44 is inserted into the positioning hole 23, thereby fixing the position of the part 21 on the die table 42.

In the adjusting step as described above, the position of the die set 43 relative to the positioning pin 44 is adjusted based on the positional relation between the positioning hole 23 and the part 21. Because the positioning hole 23 and the positioning pin 44 are arranged in the same position, the positional relation of the part 21 relative to the positioning pin 44 as a reference for adjusting the position of the die set 43 becomes consistent with the positional relation of the part 21 relative to the positioning hole 23. Therefore, the cutting-plane line can be accurately arranged along the contour of the part 21 that is set on the die set 43.

When the press die 41 lowers until it abuts on the die table 42, the part 21 is punched out along the loop antenna 13 to produce the cartridge memory 10 as a cutout.

According to the punching out method of the present invention, it is possible to accurately arrange the cutting-plane line of the die set 43 along the contour of the part 21, which can improve the working accuracy for cartridge memories 10 as well as improve the yield (percentage).

While the present invention has been described with reference to preferred embodiments thereof, it is to be understood that various changed and modifications may be made without departing from the spirit of the invention.

In the above embodiment, as shown in FIG. 4, the die set 43 is moved along the longitudinal direction and the width direction of the tape-like member 20 to adjust its position. However, based on the positional relation between the positioning hole 23 and the part 21, the die set 43 may turn around the vertical axis of the die set 43 to adjust its position. In this configuration, the positional relation between the positioning hole 23 and two corner portions of the part 21 (FIG. 2) may be detected, so as to accurately detect the direction of the part 21. Because the die set 43 can rotate along its vertical axis and adjust its position in accordance with the direction of the part 21, it is possible to improve the working accuracy for cartridge memories 10.

The position detecting unit 33 may detect the positional relation between the barycenter 23*a* of the positioning hole 23 and the barycenter 13*b* of the corner portion 13*a* of the loop antenna 13, so as to detect the positional relation between the positioning hole 23 and the part 21. Further, a reference mark such as a cross-shaped reference line mark may be printed on the part 21, and the positional relation between the positioning hole 23 and this reference mark may be detected so as to detect the positional relation between the positioning hole 23 and the part 21.

What is claimed is:

1. A method for punching out a plurality of parts from a tape member to produce cutouts by using a press machine equipped with a die set and a positioning pin, the tape member including the plurality of parts to be punched out and positioning holes for positioning the parts, the method comprising the steps of:

a capturing step for capturing one after another an image of at least one positioning hole and a corresponding part;

a position detecting step for detecting a positional relation between the positioning hole and the part based on the image obtained in the capturing step;

an adjusting step for adjusting, based on the positional relation between the positioning hole and the part, a position of the die set relative to the positioning pin when the part is set on the die set, so that a cutting-plane line is arranged along a contour of the part; and a punching out step for punching out the part by the die set to produce a cutout after placing the part on the die set with the positioning pin being inserted into the positioning hole.

2. A method for punching out a plurality of parts from a tape member according to claim 1, wherein the position detecting step comprises detecting a positional relation between the positioning hole and a corner portion of the part is detected.

3. A method for punching out a plurality of parts from a tape member according to claim 2, wherein the detection of the positional relation between the positioning hole and the corner portion of the part is carried out by detecting a positional relation between a barycenter of the positioning hole and a barycenter of the corner portion.

4. A method for punching out a plurality of parts from a tape member according to claim 1, wherein a positional relation between the positioning hole and a reference mark printed on the part is detected in the position detecting step.

5. A method for punching out a plurality of parts from a tape member according to claim 1, wherein the adjusting step further includes a step for moving the die set along a longitudinal direction and a width direction of the tape member.

6. A method for punching out a plurality of parts from a tape member according to claim 1, wherein the adjusting step further includes a step for turning the die set around a vertical axis of the die set.

7. A method for punching out a plurality of parts from a tape member according to claim 1, wherein a relative position of the part relative to the positioning hole is detected in the position detecting step, and wherein the adjusting step further includes a displacement distance calculating step which includes a step for comparing the current relative position of the part relative to the positioning hole with the previous relative position that has just been detected, and a step for calculating displacement distances on the basis of the comparison result.

8. An apparatus for punching out a plurality of parts from a tape member to produce cutouts, the tape member including along its longitudinal direction a plurality of parts to be punched out and positioning holes for positioning the parts, the apparatus comprising:

a transferring system which transfers the tape member along the longitudinal direction of the tape member;

a press machine including a die set which punches out one after another the parts when the tape member is transferred to and stopped on the die set, and a positioning pin provided near the die set and inserted into a corresponding positioning hole when each of the parts is punched out, each of the positioning hole being provided in a predetermined position close to an outside of each part;

an image capturing device which is provided upstream of the press machine as viewed from the transferring direction of the tape member, and captures an image of each part and the corresponding positioning hole; and a positioning controller which detects a positional relation between the positioning hole and the part based on the image obtained by the image capturing device, and based on the positional relation between the positioning hole and the part, adjusts a position of the die set relative to the positioning pin when the part is set on the die set, so that a cutting-plane line is arranged along a contour of the part, wherein in a state where the part is set on the die set and the positioning pin is inserted into the positioning hole, the die set, the position of which has been adjusted by the positioning controller, punches out the part to produce a cutout.

9. An apparatus for punching out a plurality of parts from a tape member according to claim 8, wherein the transferring system includes:

a supply reel for feeding out the tape member toward the press machine;

a take-up reel for taking up the tape member from which the parts have been punched out; and a pair of guide rollers each provided upstream and downstream of the press machine and guiding the tape member, wherein each guide roller has guide pins engageable with perforation holes provided along both outer edges of the tape member along the parts, so that rotation of the guide rollers allows the tape member to be fed out downstream, and wherein one of the perforation holes, which positions in a predetermined position close to the part, is used as the positioning hole.

10. An apparatus for punching out a plurality of parts from a tape member according to claim 8, wherein the positioning controller includes:

a position detecting unit which detects a relative position of the part relative to the positioning hole based on the image captured by the image capturing device;

a displacement distance calculating unit which calculates displacement distances of the die set such that the position of the die set relative to the positioning pin is consistent with the relative position of the part relative to the positioning hole that is detected by the position detecting unit; and a movement instructing unit which produces an instructing signal based on the displacement distances calculated by the displacement distance calculating unit and transmits the same to the press machine.

11. An apparatus for punching out a plurality of parts from a tape member according to claim 10, wherein the press machine includes a driving unit which receives the instructing signal outputted from the movement instructing unit and then moves the die set along a longitudinal direction and a width direction of the tape member based on this instructing signal.

12. An apparatus for punching out a plurality of parts from a tape member according to claim 10, wherein the press machine includes a driving unit which receives the instructing signal outputted from the movement instructing unit and then turns the die set around a vertical axis of the die set based on this instructing signal.

13. An apparatus for punching out a plurality of parts from a tape member according to claim 10, wherein the position detecting unit detects a positional relation between the positioning hole and a corner portion of the part.

14. An apparatus for punching out a plurality of parts from a tape member according to claim 13, wherein the detection of the positional relation between the positioning hole and the corner portion of the part is carried out by detecting a positional relation between a barycenter of the positioning hole and a barycenter of the corner portion.

15. An apparatus for punching out a plurality of parts from a tape member according to claim 10, wherein the position detecting unit detects a positional relation between the positioning hole and a reference mark printed on the part.

16. An apparatus for punching out a plurality of parts from a tape member according to claim 8, wherein the part is a cartridge memory used for a tape-like storage media cartridge.

17. An apparatus for punching out a plurality of parts from a tape member according to claim 8, wherein the image capturing device comprises a CCD camera.

18. An apparatus for punching out a plurality of parts from a tape member to produce cutouts by using a press machine equipped with a die set and a positioning pin, the tape member including the plurality of parts to be punched out and positioning holes for positioning the parts, the apparatus comprising:

a capturing means for capturing one after another an image of at least one positioning hole and a corresponding part;

a position detecting means for detecting a positional relation between the positioning hole and the part based on the image obtained by the capturing means;

an adjusting means for adjusting, based on the positional relation between the positioning hole and the part, a position of the die set relative to the positioning pin when the part is set on the die set, so that a cutting-plane line is arranged along a contour of the part; and a punching out means for punching out the part by the die set to produce a cutout after placing the part on the die set with the positioning pin being inserted into the positioning hole.

19. An apparatus for punching out a plurality of parts from a tape member according to claim 18, wherein the position detecting means comprises means for detecting a positional relation between the positioning hole and a corner portion of the part.

20. An apparatus for punching out a plurality of parts from a tape member according to claim 18, wherein the position detecting means comprises means for detecting a positional relation between the positioning hole and a reference mark printed on the part.

* * * * *